United States Patent [19]

Kulp et al.

[11] Patent Number: 5,026,204

[45] Date of Patent: Jun. 25, 1991

[54] TRAFFIC CONTROL ELEMENT AND METHOD OF ERECTING AND STABILIZING SAME

[75] Inventors: Jack H. Kulp, San Juan Capistrano, Calif.; John D. McKenney, Taos, N. Mex.; James P. Sullivan, Orange, Calif.

[73] Assignee: TrafFix Devices, Inc., San Clemente, Calif.

[21] Appl. No.: 443,517

[22] Filed: Nov. 29, 1989

[51] Int. Cl.[5] ..... E01F 9/00

[52] U.S. Cl. ..... 404/10; 404/13; 116/63 P

[58] Field of Search ..... 404/6, 9, 10, 13; 116/63 P, 63 R; 340/908.1

[56] References Cited

U.S. PATENT DOCUMENTS

| | | | |
|---|---|---|---|
| 2,762,327 | 9/1956 | Weig | 116/63 |
| 2,808,803 | 10/1957 | Weig | 116/63 |
| 3,952,690 | 4/1976 | Rizzo et al. | 116/63 |
| 4,006,702 | 2/1977 | St Cyr | 116/63 P |
| 4,083,033 | 4/1978 | Kulp et al. | 340/114 R |
| 4,256,050 | 3/1981 | Bernard | 116/63 P |
| 4,317,617 | 3/1982 | Charlton | 116/63 P |
| 4,475,101 | 10/1984 | Kulp et al. | 404/6 |
| 4,674,431 | 6/1987 | Cory | 116/63 P |
| 4,710,053 | 12/1987 | Kulp et al. | 404/9 |
| 4,782,783 | 11/1988 | Kulp et al. | 404/9 |

FOREIGN PATENT DOCUMENTS 2122239 1/1984 United Kingdom .

OTHER PUBLICATIONS

Glasdon Company–"Maxicade System" literature, 4 pages–prior page 2.

TrafTech Devices, Inc. channelizer literature, 2 pages prior art–front page e.

*Primary Examiner*—Bruce M. Kisliuk
*Assistant Examiner*—Roger J. Schoeppel
*Attorney, Agent, or Firm*—Edward J. DaRin

[57] ABSTRACT

A two-piece, detachable traffic channelization element having an improved base element. The base element has a low profile, dome-like configuration with a ballast storage chamber. The storage chamber may be completely filled with a sand ballast and sealed in its storage condition by a cover secured to the chamber. The base element is molded of a resilient crush resistant plastic so that when it is fully ballasted, need not be ballasted again, and which low profile base can be traveled over by motor vehicles without engaging the base. The detached base, filled with ballast, can be continuously traveled on by motor vehicles, including loaded trucks, without damaging the base element and rendering it useless and the need to be replaced.

36 Claims, 6 Drawing Sheets

TRAFFIC CONTROL ELEMENT AND METHOD OF ERECTING AND STABILIZING SAME

FIELD OF INVENTION

This invention relates to a traffic control element and, more particularly, to an improved base element and method for ballasting the base element for a detachable, two-piece traffic channelization element.

BACKGROUND OF INVENTION

Traffic channelizing devices are used at the present time to warn and alert drivers of hazards created by work activity in or near the traveled way and to guide and direct motor vehicle operators safely past these hazards. Drums of various configurations are one of several types of channelizing devices. Traffic channelizing drums constructed of plastic have been developed and are in extensive use. One such plastic channelizer that has been widely utilized and copied is disclosed in U.S. Pat. No. 4,083,033, granted on Apr. 4, 1978, and entitled "TRAFFIC CONTROL ELEMENT". One of the embodiments disclosed in U.S. Pat. No. 4,083,033 is a two-piece channelizing element that may be readily assembled together in a stabilized condition for traffic channelization purposes. In the commercially available, two-piece channelizer elements, the bottom piece or the base element is usually configured in a manner of an open tray for receiving a ballast which in actual practice is loose sand or a similar material or a bag or bags of sand stored in the open ballast tray for that purpose. In addition, one-piece traffic elements may store the same types of ballast within the bottom of the one-piece element. The problem of using a two-piece breakaway drum has been recognized in the art, namely, that the two pieces may disassemble when the workers attempt to drag the assembled two pieces to a new location or off the road at the end of a day's work. This may occur up to two or three times in a working day. The ballast or sand bag may be stored on such open ballast trays either horizontally or vertically in accordance with the configurations of the bases and co-acting tops of the traffic channelizers and are known to move around on their storing bases. When the open ended tray is provided with loose or bagged sand, and when the drum is dragged across a surface, a tipping action causes the ballast or sand to drop to the low side of the tipped channelizer and lean against the inside of the hollow drum. This shifting of the weight of the ballast or sand tends to release the latching mechanism which holds the top and bottom portions of the traffic channelizer together and has released the latch that is in the very area that is under maximum tension due to the dragging action. If the two pieces do not detach during this procedure, after the drum is repositioned at a new location, the sand may remain off center so that the effective forces at the latching mechanism required to release the two pieces have been altered, reduced, contrary to the original design and releases with impacts of reduced strength. The matter of dragging the two-piece element across the surface to prevent such a release of the base element has been addressed in U.S. Pat. No. 4,710,053. The problem has been minimized by the provision of skids on the base element of the traffic control channelizer disclosed in U.S. Pat. No. 4,710,053 to prevent the ready detachment of the base element from the top element during dragging. It, however, does not solve the problem of rearranging the ballast within the drum for subsequent use resulting in altering the forces at the latching mechanism required to release the top and base elements. Sand is generally the presently preferred material for ballasting a traffic control element because it is inexpensive and readily available and relatively "soft." The sand ballast typically remains in the roadway after a channelizing device has been impacted, resulting in the separation of the two pieces. This is especially the case where a two-piece breakaway plastic drum with an open ended base or tray-like element is utilized since the base, along with its ballast, usually is not displaced significantly upon the initial impact when the upper unit is knocked off or is detached from the base element. In ballasting with sand, the sand is most commonly placed in bags or stored in a similar soft breakable container which will dispense the sand upon being run over by a motor vehicle tire or tires, or will get ripped by the vehicle undercarriage. This action has been considered desirable as no large obstacle remains which will encourage evasive action to cause lofting of motor vehicles. Loose sand placed in an open to drum or an open ballast tray for a two-piece channelizer is undesirable and infrequently used for several reasons. The amount of loose sand used for ballasting often will be either insufficient or excessive. Furthermore, upon impact, the sand immediately will be spread over the driving surface. Bagged sand has the advantage in that the amount of sand and therefore the weight of the ballast can be controlled and easily handled. After devices containing bagged sand are hit or run over, sometimes even once, the bags will destruct and, again, the sand will be dispersed over the pavement. It has been found that sand on a dry driving pavement reduces the coefficient of friction between a tire and the road's surface, which results in increasing the emergency deceleration distances. Similarly, the reduction in the coefficient of friction may lead to loss of vehicle control. This degradation of performance capability occurs in the critical construction work zones where channelizing devices are commonly placed on the roadways traveled by motor vehicles, namely, on tapers, on curves, at shifts in travel patterns, and at hazardous locations. While it is recognized that sand on the pavement may adversely affect vehicle performance, this situation is considered preferable to a rigid ballast that constitutes a physical obstacle. In the proper use of all of these devices, it is recognized that an essential element of the traffic control device is an adequate ballasting element. Accordingly, traffic channelizers that are commonly termed in the art as two-piece traffic control devices are essentially three- or even four-piece devices, since the ballasting elements, such as the sand bags or the like, always have to be taken into consideration and properly mounted with the base and top elements of the so called two-piece element. Some traffic channelizing devices in the form of detachable, two-piece devices and traffic cones are known in the art that store a pre-selected volume and weight of ballast therein. A two-piece traffic channelizer of this type is disclosed in U.S. Pat. No. 3,952,690. This prior patent discloses traffic elements on highway barricades that permanently store ballast in the form of a cast iron ring in the base element or, alternatively, the base is configured with an internal, upturned flange for storing ballast in the form of concrete or a particular material such as sand. Detachable base elements fillable with loose sand are also disclosed. These prior art structures have been found to be difficult to ballast in practice. Traffic cones are generally of a unitary configuration and generally do not have a two-piece, detachable configuration. Most of the prior art traffic cones having hollow, ballast storing configurations have not been commercially successful. Traffic cones having hollow, ballast storing compartments are disclosed in U.S. Pat. Nos. 2,762,327 and 2,808,803. These patents disclose filling up the tubular ballast storing elements with sand and sealing them in fixed, secured relationship in the traffic cone. A traffic cone that is presently commercially available is identified as a "Maxicone" of the Glasdon Company. This cone is internally ballasted with sand. The deficiencies of the ballasts for the prior art traffic cones and alternate solutions are disclosed in the United Kingdom document 2122239. Some sand filled traffic cones are known to crush in use due to their design configuration and construction.

At the present time, we have no knowledge of a traffic control element and, in particular, a two-piece, detachable, attachable traffic channelizer element having a fillable base element for readily storing ballast therein and securing the ballast to eliminate the need for continuous replenishment of the ballast, generally sand bags, and yet allows the ballast to be discharged therefrom and shipped and stored without ballast. Accordingly, the present invention avoids the aforementioned problems of the prior art plastic channelizers by providing a truly two-piece traffic channelizer device which permits the base element to be filled with a stabilizing material only once and then secured within the base element so that the base need not be stabilized again and the two-piece elements can be continuously assembled and disassembled, driven over by motor vehicles, and moved from position to position without need to reballast or reassemble the separated elements.

SUMMARY OF INVENTION

The present invention provides an improved traffic channelizing device and has many aspects that substantially improve the performance of a traffic channelizing element of the types known to the prior art. The improved traffic channelizing element, in particular, relates to an improved base element for a two-piece attachable and detachable traffic channelizing element that permits the base element to be shipped without ballast and may be simply ballasted by the user once and repeatedly used by him without the need for replenishing the ballast and yet permits the ballast to be unloaded, i.e., not permanently stored therein, thereby resulting in a more practical, more effective, simpler to use, and less expensive traffic channelizing element. The base element is defined to have a ballast storage chamber of a pre-selected volume proportioned to receive a ballast of a desired weight or weights so that the chamber may be completely filled up with a pre-selected ballast and thereby correct the weight of ballast for the channelizer without any additional ballasting steps required. The base element is also advantageously constructed with a low profile, not over 4 inches in height, that allows a base element that has been separated from the top of the channelizer to have the desired clearance to fit under motor vehicles that may pass over the element without engaging the undercarriage of a motor vehicle or any other elements that may protrude therefrom. The base and the ballast are completely enclosed in accordance with the present invention so that there is minimal or no loss of ballast as a result of the channelizing element being impacted as described. The structural integrity of the base element in accordance with the present invention is also maintained, and since it essentially remains in place when separated, it may still be recognized by motorists as part of the channelizing system although of reduced target value but improved over the base elements of the prior art that have open tops and are filled with sand bags or the like. The ballasted base element of the present invention is also unique in the art in that it permits the detached base element to be repeatedly driven over by motor vehicles, including multi-wheel trucks, without destroying the base or causing tears, ruptures, bursting, or the like, leading to the loss of sand and without significant displacement from its original position. Since the weight of the ballast loaded in the base in accordance with the present invention is predetermined, the traffic channelizer may be readily ballasted to the correct weight, without over or under ballasting, by merely filling up the ballast chamber completely, such as with sand. This allows the latching mechanism built into the two pieces for the traffic channelizer to properly function in accordance with the desired design criteria for detaching the top and bottom under all conditions of use of the traffic channelizer since the ballast does not shift. This also avoids the aforementioned problems of spillage of the ballast, such as sand, on roadways. The base design is also advantageous since it can be retrofitted to present day commercially available top elements for two-piece traffic channelizers, without the need to purchase a completely new traffic control element.

From a structural standpoint, the present invention broadly comprehends the base element for a two-piece, attachable and detachable traffic control element comprising a base element molded from a crush-resistant plastic having a pre-selected, low profile, dome-like configuration with a hollow ballast storing chamber accessible through a filling aperture on one side thereof. The base element includes cover means sized to be interfitted without the use of tools with the filling aperture for completing the enclosure of the ballast storing chamber. The peripheries of the filling aperture and the cover means are constructed and defined relative to one another for releasably interlocking the cover means to the base element to enclose the ballast storing chamber, including when storing ballast therein. The ballast material selected to be stored within the chamber is characterized as a flowable mass of loose particles that are relatively incompressible for fully occupying volume of the chamber so that when the base is completely filled with said selected ballast material, it is enclosed in an essentially leakproof fashion by the interlocked cover means whereby the completed ballast base element may be repeatedly driven over or on as described hereinabove. The preferred ballast material is sand that is dampened sufficiently for packing within the base element, preferably without any voids within the damp sand mass.

From a traffic channelizing standpoint, the improved traffic channelizer of the present invention comprises a hollow element having a barrel-like configuration adapted for traffic channelization signaling purposes and an attachable base member. The hollow element and the base member are adapted to be assembled and disassembled to one another, and when assembled, function for traffic channelization purposes. When impacted by a motor vehicle, the hollow element will be separated from the base member to thereby minimize damage thereto, as well as to the motor vehicle, and allow ready reassembly of the hollow element and base member for reusability. The base member is further characterized as having an arcuate configuration corresponding to the barrel-like configuration of the hollow element with the bottom surface defined for engaging a mounting surface, the configuration of the base member defining a ballast storing chamber having an opening for receiving ballast means to be loaded within the chamber along with cover means for securing the ballast means within said chamber for preventing loss of the ballast means, including when the hollow element is impacted and separated from the base element.

Other aspects of the invention comprehend the methods of ballasting for filling the unique base element for a separable two-piece traffic channelizing element, and a method of erecting a two-piece traffic control element for temporary traffic control signaling along with a method of retrofitting the improved base element to a conventional, top portion of a traffic channelizer element.

BRIEF DESCRIPTION OF THE DRAWINGS

These and other features of the present invention will be more fully appreciated when considered in the light of the following specification and drawings, in which.

DETAILED DESCRIPTION OF THE PREFERRED EMBODIMENT

Figure 1:
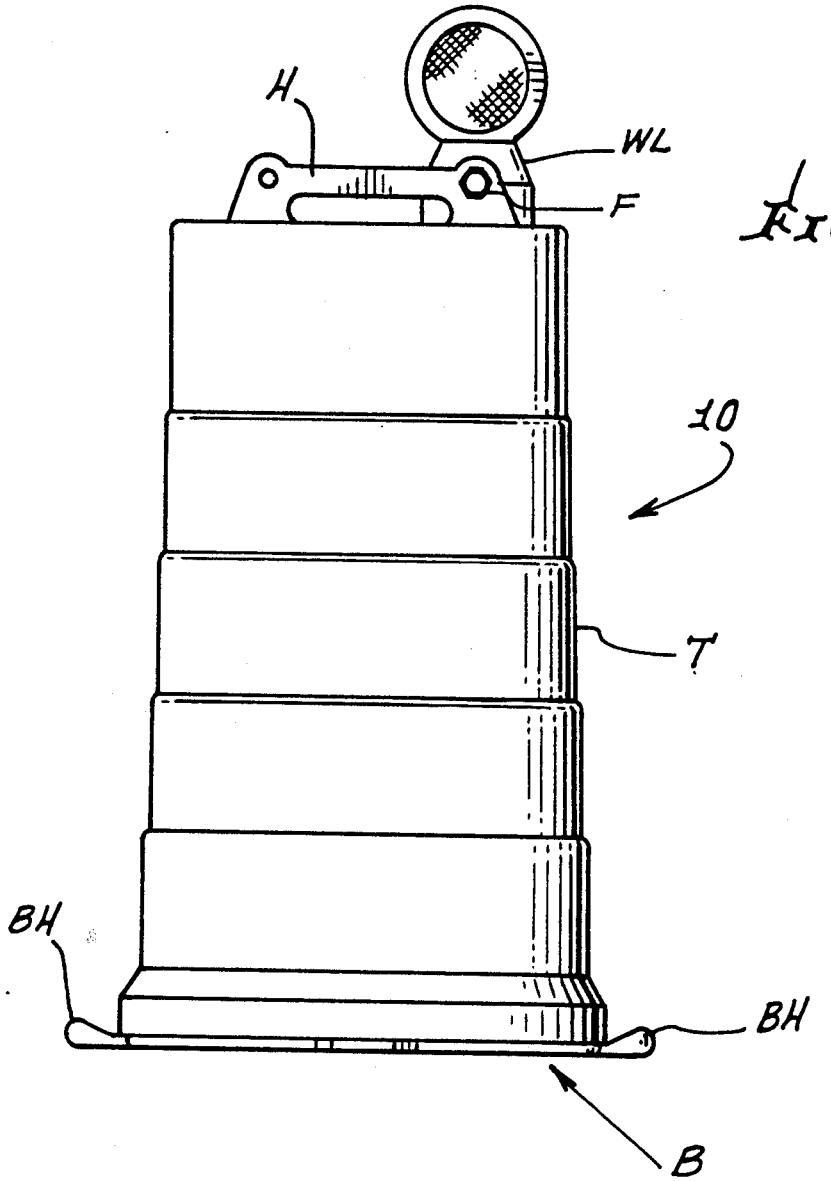
FIG. 1 is an elevational view of an assembled two-piece traffic channelizing element having a warning light mounted thereon and embodying the present invention.
Figure 2:
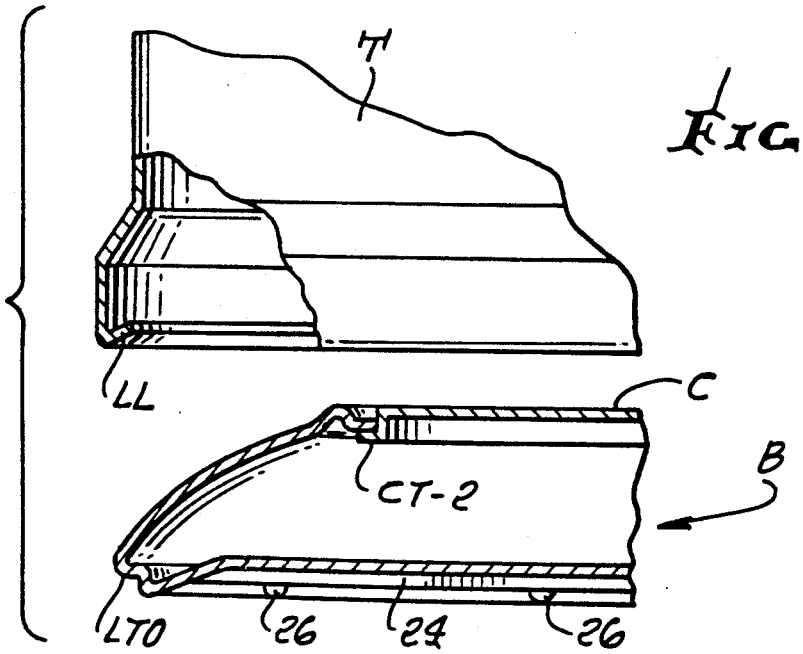
FIG. 2 is a partial view of the detached top and base elements of a traffic channelizer, with portions shown in elevation and in cross-section, in accordance with the channelizer illustrated in FIG. 1 and illustrating the cover secured thereto.

Now referring to the drawings, the traffic channelizer 10 of the present invention will be described in detail. Although the present invention discloses an improved, two-piece traffic channelizer 10 and, more particularly, discloses an improved base element B for such a channelizer, the base element is also adapted to be retrofitted to present day two-piece traffic channelizers or the channelizers of the prior art. For this purpose the improved base element B is directly useful with the top part T of the two-piece channelizer disclosed in the earlier filed design application that is co-pending with the present application and bears Ser. No. 159,651 and assigned to the same assignee as the present invention. Specifically, the base element configuration and latching mechanism for the base B of the present invention may be attached to the top portion latching system disclosed in said co-pending design application. The traffic channelizer 10 illustrated in the present drawings has a top portion T as identically disclosed in said co-pending design application and which disclosure is incorporated herein by reference. For the purposes of the present invention, the top portion T of the traffic channelizer 10 is in the form of a drum-like configuration having a tapered step design for permitting stacking of the tops of the traffic channelizers T, i.e., when the top and the base elements have been detached from one another, as is now conventional in the art. The traffic channelizer drum T has an anti-roll configuration and for this purpose is provided with a flat, anti-roll surface, preferably in a "D" configuration, as does the improved base element B. The top end of the element T is enclosed and is provided with a handle H mountable with a commercially available warning light WL. One such light WL is illustrated in FIG. 1 secured to the handle H by a fastener F in a conventional manner. The top T of the traffic channelizer 10 is also provided with a dragging bump (not shown) on the flat side thereof, permitting the traffic channelizer 10 to be dragged from one location to another by means of the dragging bumps, without causing the detachment of the base B and the top T. The bottom end of the element T is provided with a locking lip LL defined around the entire periphery thereof to extend inwardly from the outer wall of the element T for engaging a co-acting locking or latching element defined on the base element B as will be described in more detail hereinafter; see FIG. 2.

Figure 4:
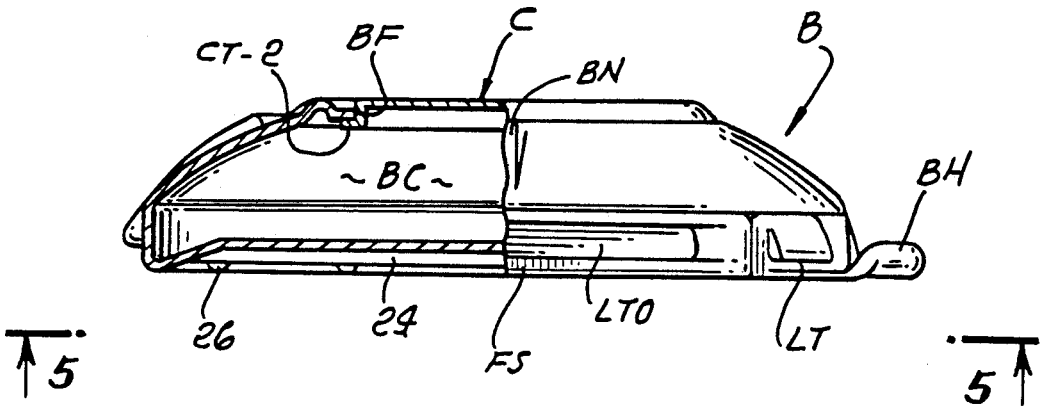
FIG. 4 is a partial elevation and cross-sectional view of the detached base element of FIG. 3, taken along the line 4—4 thereof.

Referring specifically to the drawings illustrating the base B per se, the construction of the base B will now be described in detail. The base B per se is defined with a low profile, dome-like configuration defining a ramp from the outer periphery of the base element to the ballast filling aperture BF defined in the top surface of the base. One side of the base B has a flat side FS; see FIG. 11. The ballast filling aperture BF is enclosed with a cover C for securing any ballast stored in the base element B; see FIGS. 4 and 10, for example. The base B is preferably molded of a resilient plastic with a hollow interior functioning as a ballast storing chamber BC having a pre-selected volume for providing the desired weight of a selected ballast material to be stored therein. The vertical, low height of the base element B is preferably 4 inches to permit the base to be driven over the top thereof by present day motor vehicles without any engagement with the undercarriage of the motor vehicles or any normal elements protruding downwardly therefrom. Similarly, the volume of the ballast chamber BC is constructed and defined to provide a volume for storing a pre-selected weight of the selected ballast material in the form of damp sand so that when the volume of the ballast storing chamber is completely occupied by the damp sand, namely, up to the opening BF, the chamber BC in the illustrated embodiment will store approximately 53 pounds of sand ballast. The weight of the base B, per se unballasted, is 3½ pounds, so that the stabilizing means for the top element T is 56½ pounds.

Figure 5:
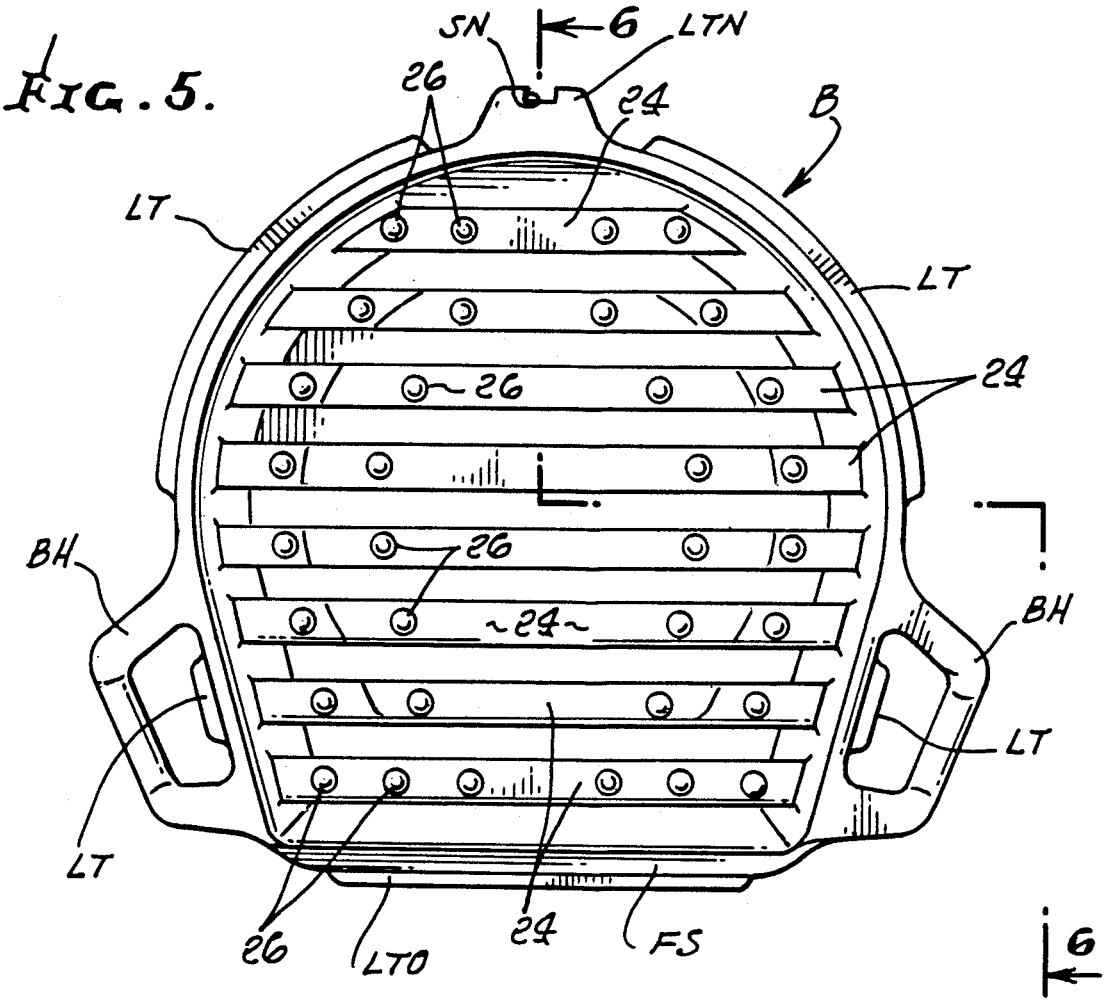
FIG. 5 is a bottom plan view of the base element illustrated in FIG. 3.

The external configuration of the base B is also provided with a pair of attache type handles BH spaced on opposite ends of the flat sides FS and extending outwardly on the opposite sides of the periphery of the base, as illustrated. In addition, a plurality of attachable locking tabs LT protrude outwardly of the base B to cause the locking lip LL of the top element T to be snap-locked thereto when it is mounted over the base and pressure is applied to the element T to cause the locking lips LL to snap under the locking tabs LT to releasably lock the two elements of the channelizer 10 together, as will be described more fully hereinafter, see FIGS. 2 and 11. The locking tabs LT are preferably provided around the approximately 300 degrees of the base periphery for improved latching action in accordance with the present invention. For this purpose, the flat side FS has a locking tooth LTO extending essentially the entire length of the flat side, as illustrated in FIG. 5. The adjacent sides of the base B to the flat side has two long arcuate tabs LT arranged on opposite sides thereof, as is evident from FIG. 5. The periphery of the base B inside the carrying handles BH also has short locking tabs LT, as illustrated. In this manner, the entire periphery of the base is provided with the locking tabs for more securely releasably engaging the top element T.

Figure 3:
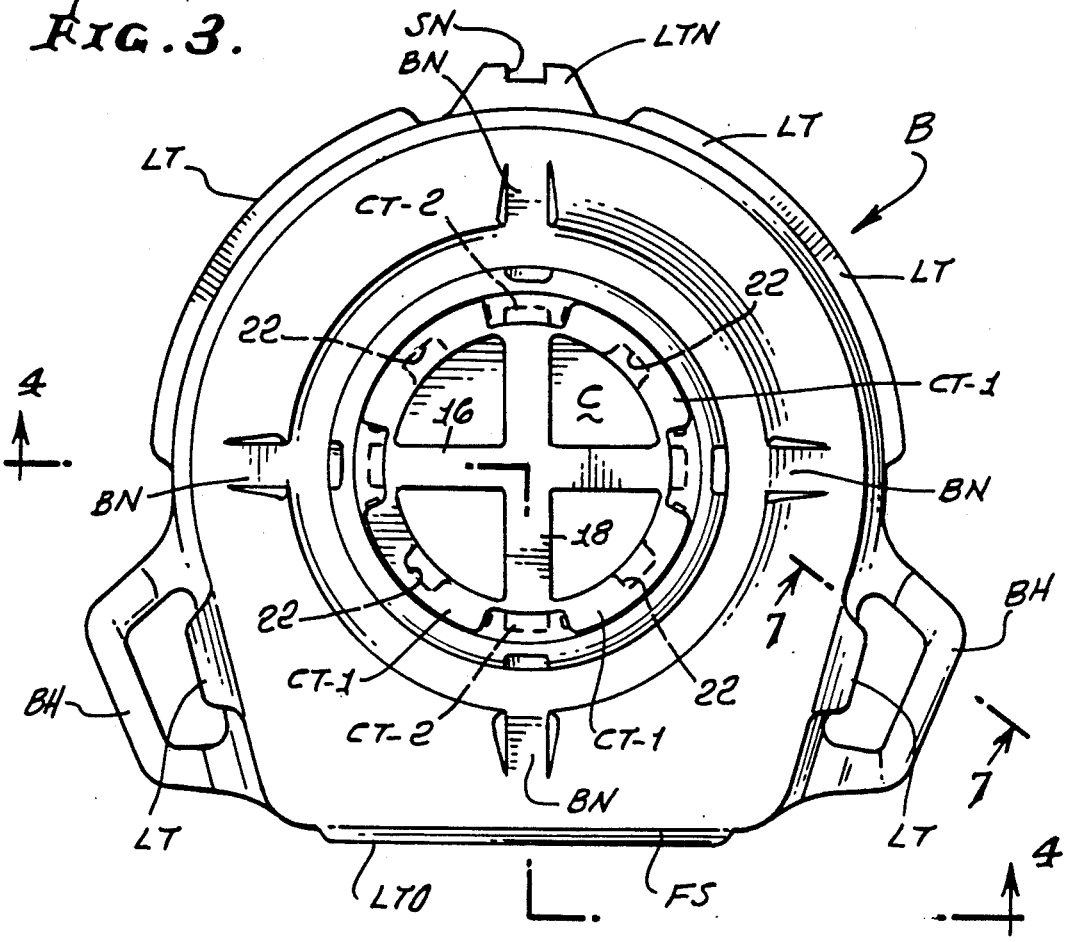
FIG. 3 is a top plan view of a detached base element of the traffic channelizer of FIGS. 1 and 2 with the cover for the base element secured in position and portions illustrated in dotted outline.
Figure 8:
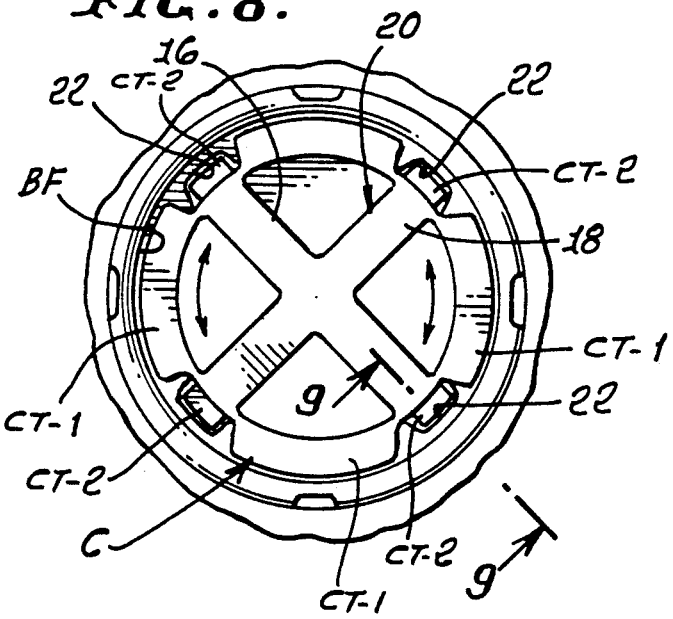
FIG. 8 is a partial, top plan view of the base element illustrated in FIG. 3 showing the cover member after rotation to an open position for permitting withdrawal from the base element proper.
Figure 9:
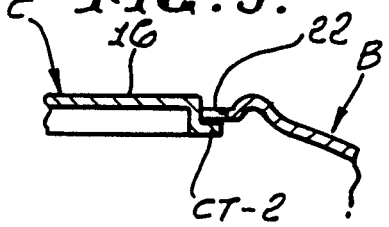
FIG. 9 is a partial sectional view taken along the line 9—9 of FIG. 8 illustrating the cover locking tab.

The ballast filling aperture BF for the base B is tightly sealed by the cover C when releasably locked thereto for preventing the loss of the sand ballast therefrom, without the need for tools to provide the desired locking/sealing action. For this purpose, the top of the cover C is constructed and defined at two different vertical levels for locking co-action with the periphery of the ballast filling aperture BF. The top, vertical level is defined by the provision of a pair of cross-members 16 and 18 that are orthogonally related and form a cross-like bar member 20 extending between the outer periphery of the top of the cover C and the center thereof; see FIG. 3 in particular. A plurality of cover locking tabs CT-1 are provided and are arranged around the periphery of the cover C and extend outwardly therefrom in a symmetrically spaced arrangement between the arcuate surfaces defined between the crossmembers 16 and 18 of the cross element 20 on the top of the cover. These cover locking tabs are identified as the tabs CT-1 and are provided with an arcuate outer periphery that extend between each of the quadrants defined by the crossmembers 16 and 18 at the same level as the top surfaces of the members for co-action with the complimentarily defined aperture BF for the base B as will be explained hereinafter. A second vertical level of cover locking tabs CT-2 is defined below the upper level of tabs CT-1 and are arranged to extend outwardly of the periphery of the cover C opposite the ends of the cross-members 16 and 18 and between the spaces defined by the upper level locking tabs CT-1 and below them as specifically illustrated in FIGS. 3 and 8. The co-action between the cover C and the base filling aperture BF for interlocking the two can be best appreciated from viewing FIGS. 3 and 8. In FIG. 3 the cover C is illustrated in its closed position with regard to the aperture BF wherein the arcuate cover tabs CT-1 are illustrated as lying on top of the peripheral surface surrounding the aperture BF. The lower level cover locking tabs CT-2 assume a position below the surface of the periphery of the aperture BF when the cover is fully locked in position as illustrated in dotted outline in FIG. 3. To accommodate the locking tabs CT-2, the ballast filling aperture BF is provided with four apertures 22 equally spaced around the periphery of the aperture and shaped to accommodate the tabs CT-2 therein for movement below the lower surface of the periphery of the aperture BF when the cover is rotated. Once the cover C has been rotated approximately 45 degrees from its closed position, the cover will be in an opened position, as illustrated in FIG. 8, immediately prior to the cover C being removed from the base element B proper. In FIG. 8 the short tabs CT-2 are visible through the peripheral apertures 22 in the base B.

When the cover C is mounted to the aperture BF for sealing off the ballast storing chamber BC, as illustrated in FIG. 8, rotation of the cover by grasping the cross element 20 between an individual's fingers, either clockwise or counter-clockwise, through approximately a 45 degree angle will cause the cover to assume the closed sealing position illustrated in FIG. 3. This arrangement seals the sand ballastor the like within the ballast chamber without any loss and yet allows the ballast to be removed when the base B is to be shipped from the job site to the storage site, if desired, to thereby render it easier to handle and transport for shipping and storage purposes. Furthermore, in the event the ballast does not completely occupy the volume of the chamber BC, it can be replenished or added to until the desired weight or volume is achieved.

Figure 14:
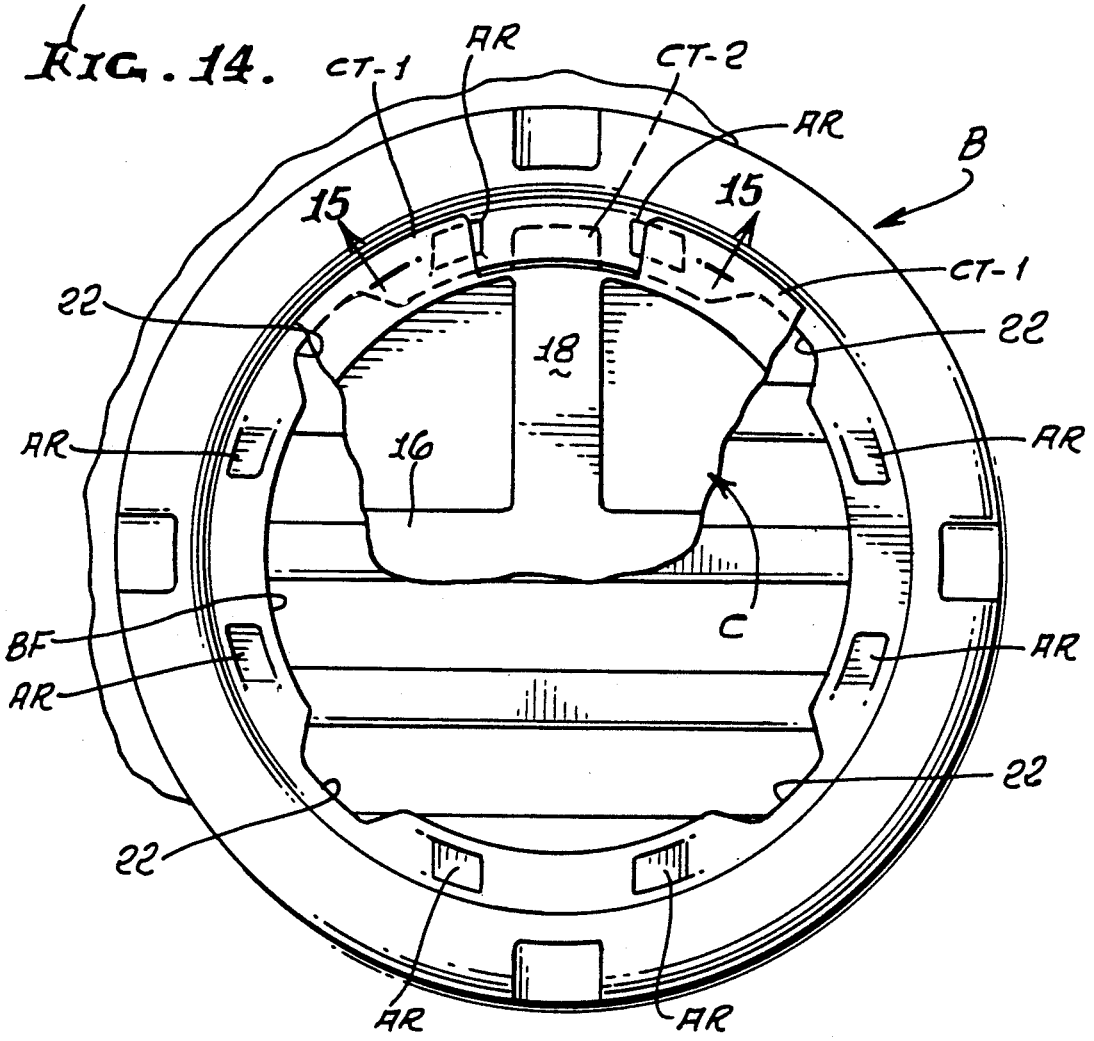
FIG. 14 is a partial, top plan view of the base element illustrated in FIG. 3 showing the cover member removed therefrom and a portion of the cover member illustrated in a secured position.
Figure 15:
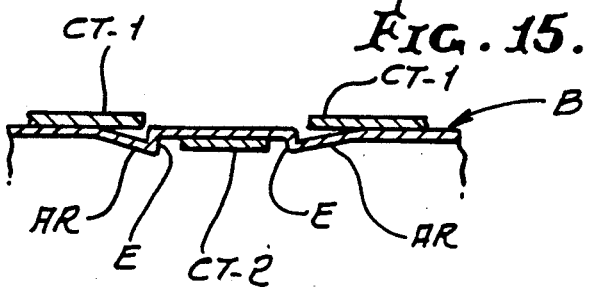
FIG. 15 is a partial sectional view taken along the line 15—15 of FIG. 14.

Referring to FIGS. 14 and 15, the integral antirotational ramps AR will be described. FIG. 14 illustrates a partial top view of the base element B with the major portion of the cover C removed for exposing the antirotational ramps AR that are integrally molded into the base element adjacent the periphery of the aperture BF for the chamber BC. In the illustrated embodiment of FIG. 14 eight ramps AR are illustrated with a pair of ramps AR spaced between each of the apertures 22. Each of the ramps is molded into the plastic so as to be depressed and extend below the plane of the peripheral surface of the aperture BF in the form of an inwardly extending ramp having a vertical end E at one end of each ramp, as best illustrated in FIG. 15. With the provision of the ramps AR, when the cover C is rotated to a closed position, the tabs CT-2 are caused to be bent downwardly progressively as a result of engaging the protruding portions of the ramps AR with the continuous rotation of the cover C. Immediately prior to the cover reaching its 45 degree closed position, the tabs CT-2 movement is arrested by the vertical ends E of the ramps AR extending below the surface of the periphery of the aperture BF; see FIG. 15. When the cover is completely closed, the tabs CT-2 will move up vertically into the compartments thus defined between the ramps AR as is illustrated in FIG. 15. This structure provides an anti-rotation barrier to prevent the unintentional rotation of the cover C leading to the opening up of the cover and the resulting loss of the stored ballast. It should be appreciated that this anti-rotation safety feature causes the cover C to be more difficult to unlock than to lock the cover C to the base element B.

Figure 7:
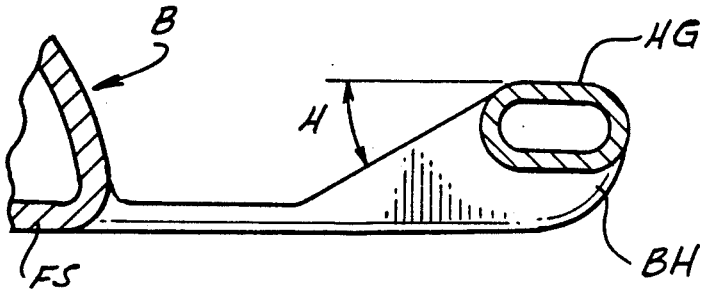
FIG. 7 is a partial sectional view of the base element handle, taken along the line 7—7 of FIG. 3.

Now referring to FIG. 7, the detailed construction of the base handles BH will be examined in detail. The handles BH that are constructed in accordance with the present invention are illustrated in the form of a conventional attache type carrying handle, but in this invention also function as foot pads to allow a worker to place his foot on a handle BH when the base is on a supporting surface or on the ground to facilitate the detachment of the channelizer top T and the base B. The handles BH are molded integrally with the base element B proper for this purpose. A handle BH is illustrated in FIG. 3, for example, wherein the portion of the handle grasped by the individual's hand or the portion HG is spaced outwardly of the base B proper and directly opposite the base locking tab LT as illustrated. As is evident from viewing FIG. 7, the gripping portion of the handle or the portion HG is arranged at an angle with respect to the bottom of the base B to extend upwardly therefrom and which angle is identified in FIG. 7 as the angle H. The handle BH per se as illustrated in FIG. 7 has a hollow construction. The bottom portion of the handle portion HG is constructed and defined so that the bottom of the handle grip HG is slightly spaced from the supporting surface to permit a user to place his finger tips in position to grip the handle. Once the handle grip HG is grasped by the user, the handle will bend upwardly in response to the user exerting force thereon at the solid molded section thereof.

The angle of the handle BH is further defined to pass through the centerline of the base B and any ballast stored therein. When the handle BH is constructed in this fashion, the center of gravity of the ballasted base B will be through the center of the handle BH and thereby renders it simple to carry without unduly stressing the carrier's arm or wrist due to any imbalance of the stored ballast. In view of the physical rigidity of the plastic utilized for molding the handle BH, it may be stomped on by the channelizer user for separating the top T and the base B to facilitate the separation of these two channelizer pieces.

Figure 6:
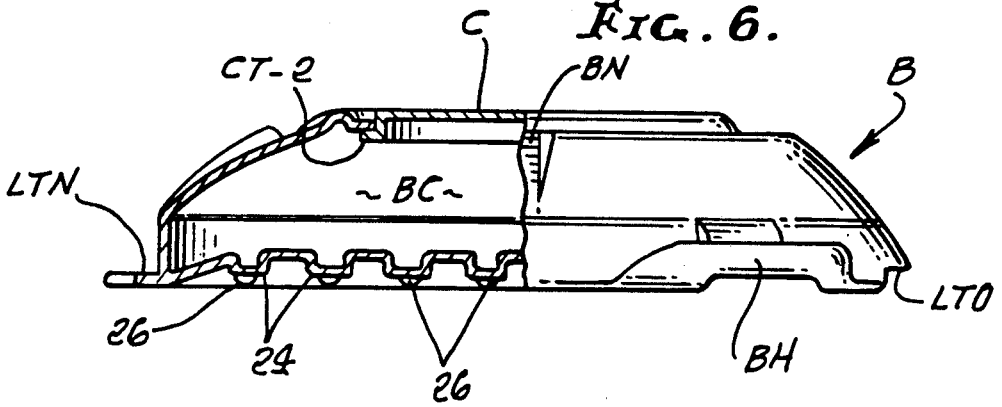
FIG. 6 is a partial elevational and cross-sectional view of the base element of FIG. 5 taken along the line 6—6 thereof.

The bottom side of the base B is constructed and defined in a unique fashion in that it is corrugated, shaped into parallel grooves and ridges, for stiffening the base element. The series of ridges 24 are spaced apart across the entire bottom area of the base B and which corrugations lie parallel to the flat side FS of the base B proper; see FIGS. 5 and 6. The ridges 24 of the corrugations are defined to engage the supporting surface for the base and stiffen the base on the order of 10 to 1 from other known prior art designs, such as flat pan design having no ribs or corrugations. In accordance with the present invention, this increased structural rigidity and stiffness provided by the corrugated bottom design prevents the base from sagging and becoming bulbous, i.e., convex after filling with approximately 53 pounds of ballast. A bulbous shape for the bottom surface of the base B when supported on a flat road surface, for example, with the top T of the channelizer 10 secured thereto will cause the channelizer to rock back and forth with motor vehicles traveling by the channelizer. In accordance with the present invention, the bottom surface of the base B is intentionally molded slightly concave so that when properly ballasted, the bottom surface will be parallel to the flat supporting surface of a roadway.

The bottom of the base B is also provided with a multiplicity of anti-skid teeth or protrusions 26. The anti-skid teeth 26 are illustrated in FIG. 5 secured to the bottom surfaces of the ridges 24 of the corrugations in a spaced apart relationship with at least two circles of anti-skid elements 26 arranged on the top of each corrugation and ridge 24. This is to provide the anti-skid or anti-skate feature for the assembled, ballasted traffic channelizer 10 when it is subjected to winds or gusts or vibrations caused by motor vehicles speeding by for maintaining the channelizer in positioned position.

In preparation for erecting the traffic channelizer 10, the base B must have its ballast storing chamber BC filled with a pre-selected ballast material. The ballast material may be any desired ballast material that will add stabilizing weight to the erected traffic channelizer 10. The presently preferred ballasting material is common sand S, which comprises loose, gritty particles of worn or disintegrated rock, or any similar particulate material. One of the advantages of sand is that it is relatively inexpensive and yet has the desired physical characteristics for use in the present invention. The preferred sand ballast or any equivalents thereof can be characterized as a flowable mass of loose particles that are relatively incompressible and adapted to fully occupy the volume of the ballast storage chamber so that when the storage chamber is completely filled with sand ballast and the chamber is enclosed with its cover, the ballast will be stored in an essentially leakproof fashion, i.e., without loss of ballast in the use of the traffic channelizer. In ballasting the base B, it is preferable to dampen the sand to an extent that it can be readily packed into the base without any voids in the ballast. In this procedure it is preferred that the dampened sand be packed up to the perimeter of the aperture BF and completely filling every cubic inch (without voids) of the ballast chamber BC. It has been found that when the sand ballast completely fills up the storage chamber in this manner, the detached base B may be repeatedly traveled over without crushing, bursting or cracking the base B and may be continuously used without the need for a new base element or to replenish the sand ballast.

Figure 10:
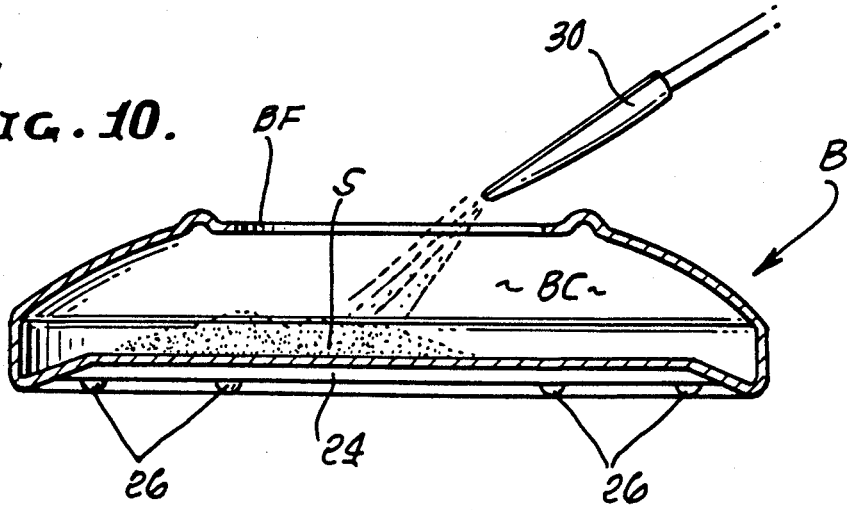
FIG. 10 is a cross-sectional view of the base element with the cover member removed therefrom and diagrammatically illustrating a method of filling up of the ballast storage chamber with sand.

The ballast aperture BF is defined to have a centrally located, large opening on the order of an 8 inch diameter for receiving the ballast, and for this purpose the ballast may be loaded into the ballast chamber BC by means of a shovel 30 to facilitate the loading of the ballast in the chamber, as is evident from viewing FIG. 10. The sand ballast is preferably loaded to completely occupy the volume of the storage chamber BC right up to the opening BF, thereby predicting the weight of the ballast stored therein. In this fashion when the aperture BF is locked closed by the cover C, the entire base B will be filled, without any voids that may cause the base B to be damaged when traveled over by vehicles. At those time intervals in which a motor vehicle runs over the top of the base B, it has been found that the sand is sufficiently compressible and deformable, with the lack of voids in the packed sand, that the plastic material selected for molding the base B will deform slightly along with the sand in response to the weight of a vehicle to prevent the destruction of the base B. Multiwheeled, loaded vehicles have been subjected to the base B when it is loaded, and minimal destruction, leakage or bursting of the base to cause the loss of the sand ballast has been experienced. It is believed that the stored sand in the base B gives additional rigidity and internal support to the base, thereby rendering it essentially nondestructible under ordinary use. The sand is also advantageous in that it is useful in all sorts of temperatures, including freezing temperature. Since the sand fills up the volume of the ballast chamber, it remains in place and responds to any pressure applied by a motor vehicle wheel by maintaining its relationship with the inner walls of the chamber BC to prevent it from independently responding to the outside pressure and therefore minimizes the incidence of cracking, crushing, bursting, or the like.

Figure 11:
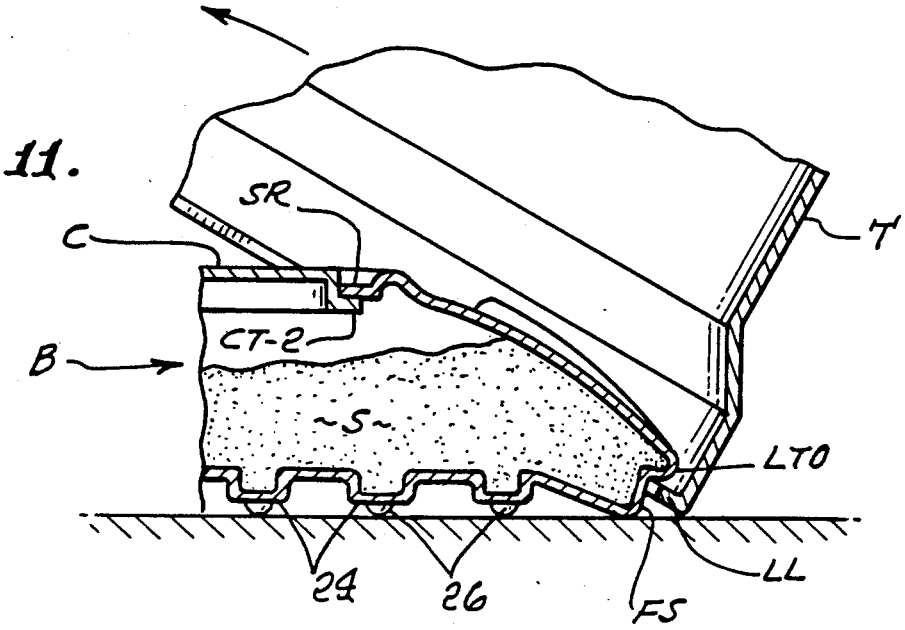
FIG. 11 is a partial sectional view of the traffic channelization element of FIG. 1 illustrating a method of lockably attaching the base and top elements.

Now referring to FIG. 11, the preferred method of assembling the top element T and the base B will be examined. It will be recalled that the bottom surface of the top part T for the channelizer 10 has a locking lip LL extending inwardly around the entire periphery of the bottom, open end of the element T. In accordance with the present invention, the preferred method of assembling the top T and the base B is to set the top T over the base B at the flat side FS of the base by inserting the locking lip LL under the locking tooth LTO and rocking the top T forward or away from the assembler to shape form and snap lock the two pieces together. In rocking the top T forward, it has been found that the flat side FS of the base acts as a hinge line for permitting the rocking of the top element T into engagement with the base to cause a better inter-engagement of the locking tabs LT and the locking tooth LTO provided on the base element.

The construction of the base B is constructed so that the wall of the flat side FS is inclined at a small angle on the order of 15 degrees; see FIG. 11. When the top T is placed over the base B, the locking lip LL of the top will rest on the supporting surface so that when the top T is rocked forward, the locking lip LL will ride along the inclined surface FS for providing an improved locking action with the locking tooth LTO.

When the channelizer 10 of the present invention is impacted by a motor vehicle, it has been found that the open end (bottom) of the top element T will assume an egg shape or worse. As a result of the dome shape provided for the base B, when such a deformed element T is attached to the base, the base functions to shape and form the deformed element T from a non-round to a round configuration for securing the elements B and T together. During the time interval the top element T is being rocked forward to attach it to the base B over the dome shape of the base B, it is reconfigured to a round shape by the engagement with the base to permit it to be snap-locked to the base B. When the channelizer 10 is assembled in this fashion, it is ready for use on a highway, road or the like for its intended purpose. The fact that the sand ballast S occupies the complete volume of the ballast storing chamber BC prevents the ballast from moving around in its storage chamber BC in response to the relocation of the channelizer, either by picking it up vertically off the ground or by tipping and dragging it along the supporting surface or when impacted by a motor vehicle. This does not cause the weight of the base to be shifted and affect the latching action of the locking elements and locking lip for the elements B and T and makes for a more secure, predictable operation of the traffic channelizer 10 than prior art two-piece channelizers. It should now be recognized that once the base is filled and the two pieces disassembled that the base may be moved to another location without the need to retrieve the ballast or have the ballast strewn over the roadway, and the base may be conveniently carried by means of the handle BH to a new location and then reassembled at that location with a minimum amount of effort and with a predictable amount of weight in the base element B. This type of channelizer 10 is considered less expensive to use when the base B is filled with sand than the prior art type devices, and the base B is readily attachable to present day two-piece channelizers as discussed hereinabove.

Figure 12:
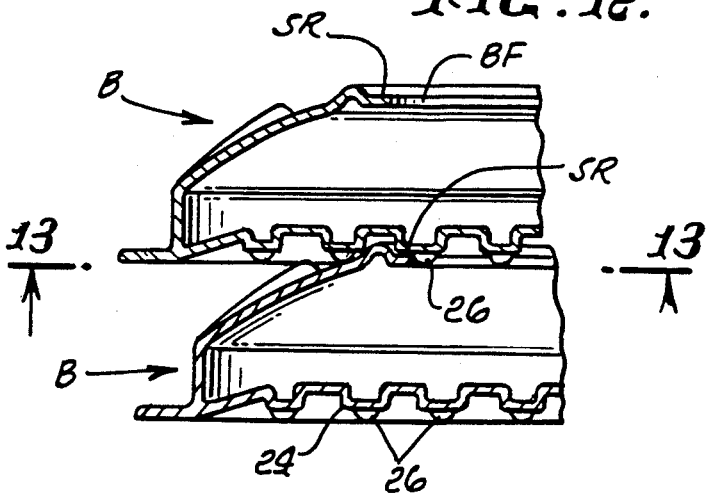
FIG. 12 is a partial cross-sectional view of a plurality of base elements illustrated in a stacked relationship.
Figure 13:
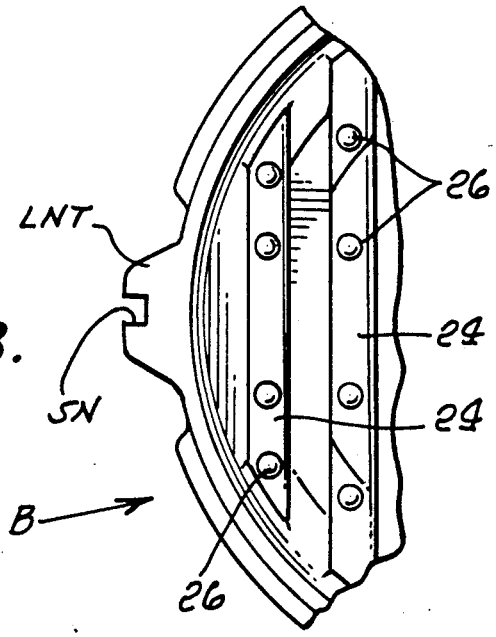
FIG. 13 is a partial elevational view of the stacked base elements of FIG. 12 taken along the line 13—13 of FIG. 12.

Now referring to FIGS. 12 and 13, the manner of stacking the base element B independent of the top element T will be examined. For this purpose it should be noted that the upper top portion of the outside surface of the base B includes a stacking ring SR which is concentric with the ballast filling aperture BF and is arranged outwardly thereof as best illustrated in FIG. 3. The stacking ring SR is at a lower level than the top of the domed portion of the base or the surface of the base immediately adjacent the aperture BF. One ring of the anti-skid teeth 26 is arranged in a pattern on the bottom of the base B for complementary interfitting into the stacking ring SR. For this purpose the inner pattern of teeth 26 are arranged in a circular pattern as illustrated in FIG. 5 so as to slip into the stacking ring SR when the bases are stacked one on top of another as illustrated in FIG. 12. When the bases B are stacked in this manner, it will be recognized by those skilled in the art that the stacked bases may rotate relative to one another.

For shipping a stacked group of base elements and securing them from movement, the bases B may be secured together by a metal band (not shown) in a conventional fashion. To prevent the securing band from slipping off the stacked bases B, each base is provided with a stacking notch SN at the tab LNT opposite the locking tooth LTO as illustrated in FIGS. 3, 5 and 13. The securing band will be located in the stacking notch SN to prevent the slippage thereof from the secured, stacked bases B.

We claim:

1. A base element for a two-piece traffic control element comprising a molded plastic base element having a dome-like external shape and pre-selected hollow configuration for storing a pre-selected quantity of ballast means within the hollow, and having an opening for introducing ballast means within the hollow, ballast means comprising loose, particulate material packed for filling the hollow portion of the base element and means for securing the base opening to prevent any loss of the ballast means from the base element and to maintain the ballast means in place within the base element, the thus defined and ballasted base element permitting reusability of the base element, including after being subjected to the weight of a motor vehicle thereon traveling thereover.

2. A base element as defined in claim 1, including handle means integrally molded with the base element for facilitating carrying of the base element and to function as a step pad for releasing the base element from the other piece of the traffic control element.

3. A base element as defined in claim 1 or 2 wherein the bottom surface of the base element is constructed and defined with a corrugated configuration for stiffening the base element.

4. A base element as defined in claim 3 wherein the base element is provided with a flat side and the corrugations extend in a parallel relationship with said flat side on the bottom surface of the base element.

5. A base element as defined in claim 4 wherein the bottom surface includes anti-skid means spaced thereon.

6. A base element as defined in claim 4 wherein the corrugations on the bottom surface comprise a multiplicity of parallel grooves and ridges with the ridges engaging the ground and having anti-skid means spaced on at least a plurality of the ground engaging sides of the ridges of the corrugations.

7. A base element for a two-piece traffic control element as defined in claim 1 wherein the means for securing the base opening is constructed and defined to coact with the base openings to seal the ballast means within the base element and to be readily assembled and disassembled therefrom.

8. A base element for a two-piece traffic control element having a hollow element and a base element adapted to be releasably interlocked for functioning as a traffic control element, the improved base element comprising a molded, resilient plastic base element having a pre-selected hollow configuration for storing ballast means within the hollow and having an opening for receiving and storing of ballast means within the hollow, and a lockable cover adapted for closing the opening of the base element, the periphery of the opening for the base element and the periphery of the cover being constructed and defined in a complementary configuration to be locked together for securing the ballast means therein.

9. A base element for a two-piece traffic control element as defined in claim 8 wherein said base element has a generally circular configuration with a substantially flat bottom surface for engaging a mounting surface and solid side walls inclined at a pre-selected angle upwardly from the adjacent outer peripheral edge of the base element towards the peripheral edge of the opening of the base element.

10. A base element for a two-piece traffic control element as defined in claim 8 or 9 wherein the base element and the cover are molded from a crush resistant, resilient plastic material permitting a motor vehicle to repeatedly travel over the base element without crushing the base element and the cover locked thereto when the ballast means stored therein completely fills said hollow for the base element.

11. A base element for a two-piece, attachable and detachable traffic control element comprising a base element molded from a crush resistant plastic having a low profile, pre-selected dome-like configuration with a hollow ballast storing chamber accessible through a filling aperture on one side thereof and cover means sized to be interfitted with said filling aperture for completing the enclosure of the ballast storing chamber, the peripheries of the filling aperture and the cover means being constructed and defined for releasably interlocking the cover means to the base element to enclose the ballast storing chamber, including when storing ballast therein, the ballast material selected to be stored within said chamber being characterized as a flowable mass of loose particles that are relatively incompressible and adapted to fully occupy the volume of said chamber so that when the base is completely filled with said selected ballast material, it is enclosed in an essentially leak proof fashion by the interlocked cover means, whereby the completely ballasted base element may be repeatedly traveled over, including by motor vehicles, without the destruction, tearing or bursting of the base element due to being traveled over and the low profile, dome-like shape is selected to allow a motor vehicle to travel over the top of the base element without engagement with the underside of motor vehicles.

12. A base element for a two-piece, attachable and detachable traffic control element as defined in claim 11 wherein the selected ballast material is damp sand packed and stored within the base elements preferably without any voids within the sand mass.

13. A base element for a two-piece traffic control element comprising a base element having a dome-like shape with a pre-selected hollow configuration for storing ballast means within the hollow and an opening for receiving ballast means therethrough to be stored therein, and cover means adapted to be interfitted with the base element at the opening thereof to close the opening and to be locked thereto, and thereby securing any ballast means stored therein, including after the traffic control element is impacted by a motor vehicle, the periphery of the base element having a configuration adapted to be releasably interlocked with a hollow element for the two-piece traffic control element.

14. A base element for a two-piece traffic control element as defined in claim 13 wherein the bottom of the base element is constructed and defined with stiffening corrugations.

15. A base element for a two-piece traffic control element as defined in claim 13 or 14 wherein the base element includes at least a single handle extending outwardly of the base element for transporting the base element, including when it is storing ballast means.

16. A base element for a two-piece traffic control element as defined in claim 13 or 14 including at least a single handle extending outwardly therefrom constructed and defined for carrying the base element and for clamping the base element to a supporting surface by means of a foot or the like for releasing a hollow element interlocked with the base element.

17. A base element for a two-piece traffic control element as defined in claim 13 or 14 including a pair of carrying elements constructed integrally with the base element and each of said elements extending outwardly from the base element therefrom from opposite sides of the base element.

18. A base element for a two-piece traffic control element as defined in claim 14 wherein the bottom of the base element includes a multiplicity of dependent, spaced elements for engaging a mounting surface in an anti-skid relationship by means of said dependent elements.

19. A base element for a two-piece traffic control element as defined in claim 18 wherein the stiffening corrugations comprise a multiplicity of parallel grooves and ridges, each ridge including at least a pair of said dependent elements spaced thereon.

20. A base element for a two-piece traffic control element as defined in claim 13 including at least a single attache type carrying handle defined to extend outwardly of the base element for transporting the base element including any ballast means stored therein, said handle being defined to extend through the centerline of the base element and any ballast means stored therein upon holding the base element in a substantially vertical orientation by means of said handle.

21. A base element for a two-piece traffic control element as defined in claim 19 wherein the base element has at least a single flat side defined thereon and the corrugations extend in a parallel relationship with said flat side.

22. A base element for a two-piece traffic control element as defined in claim 21 wherein the corrugations are integrally defined with anti-skid means thereon.

23. A traffic channelization element comprising a hollow element having a barrel-like configuration adapted for traffic channelization signaling purposes, and a base member, the hollow element and the base member being adapted to be assembled and disassembled to one another and when assembled function for traffic channelization purposes whereby upon impact, the hollow element will be separated from the base member to thereby minimize damage thereto and allowing ready re-assembly of the hollow element and base member for reusability, the base member being further characterized as having an arcuate configuration corresponding to the barrel-like configuration of the hollow element with a bottom surface defined for engaging a mounting surface, the configuration of the base member defining a ballast storing chamber having an opening for receiving ballast means to be loaded within the chamber, the base member including cover means for releasably securing said storing chamber opening and thereby the ballast means within said chamber for preventing loss of the ballast means from the chamber, including when the hollow element is impacted and separated from the base element.

24. A traffic channelization element as defined in claim 23 wherein the hollow element is constructed and defined with a pre-selected outer configuration to be roll resistant.

25. A traffic channelization element as defined in claim 23 or 24 wherein the base element bottom surface is constructed and defined with a stiffened bottom surface.

26. A traffic channelization element as defined in claim 23 wherein the base element ballast storing chamber is filled with a relatively incompressible ballast material and is secured within the ballast storing chamber.

27. A traffic channelization element as defined in claim 26 wherein the ballast material is sand that is packed within the ballast storing chamber in a dampened condition so that the sand can be packed essentially without any voids and completely fills up the chamber.

28. A traffic channelization element as defined in claim 23 wherein the base element is sized in height to permit motor vehicles to travel over the base element when separated from the hollow element without engaging the bottom side of the motor vehicle or any components secured thereto.

29. A traffic channelization element as defined in claim 28 wherein the base element is constructed and defined of a resilient, crush resistant plastic material that permits the ballasted base element to be repeatedly run over by the tires of motor vehicles without tearing or bursting of the plastic material and without significant displacement of the base element.

30. A traffic channelization element as defined in claim 26 wherein the ballast material is a continuous mass of loose, particulate material packed in a dampened condition for filling up the entire volume of the ballast storing chamber without any significant voids and enclosed therein by said securing means in an essentially leak-free relationship.

31. A traffic channelization element as defined in claim 24 wherein the hollow element is constructed with a flat, anti-roll surface at least at the end to be assembled to and disassembled from the base element, the base element having a flat surface arranged to be interfitted with the flat surface of the hollow element, the base element having stiffening corrugations constructed and defined on the bottom surface of the base element and arranged thereon to extend in a parallel relationship with the flat side of the base element.

32. A traffic channelization element as defined in claim 31 including anti-skid means defined on the bottom surface of the base element.

33. A traffic channelization element as defined in claim 32 wherein the anti-skid means comprises a plurality of anti-skid elements arranged in a spaced apart relationship on the corrugated, surface engaging portions of the corrugations.

34. A traffic channelization element comprising a hollow element having a barrel-like configuration adapted for traffic channelization signaling purposes, and a base member, the hollow element and the base member being adapted to be assembled and disassembled to one another and when assembled and disassembled to one another and when assembled function for traffic channelization purposes whereby upon impact, the hollow element will be separated from the base member to thereby minimize damage thereto and allowing ready reassembly of the hollow element and base member for reusability, the base member being further characterized as having an arcuate configuration corresponding to the barrel-like configuration of the hollow element with a bottom surface defined for engaging a mounting surface, the configuration of the base member defining a ballast storing chamber for receiving a continuous mass of loose, gritty particles to be loaded within the chamber including completely filling the storage chamber, the base member including cover means for securing the ballast means within said chamber for preventing loss of the stored ballast means from the chamber including when impacted and traveled over.

35. A stackable base element for a two-piece traffic channelizing element when the stackable base elements have been disassembled from the other piece of the traffic channelizer, the base element comprising a molded plastic element having a pre-selected hollow configuration for storing ballast means therein and an aperture for introducing ballast means therein, cover means for releasably closing said aperture for introducing the ballast means therein, the bottom surface of the base element including a plurality of dependent elements arranged in a pre-selected pattern for use in stacking over another base element having the same configuration, the base element surface and said dependent elements being complimentarily defined and constructed to interfit with one another in a stacked relationship.

36. A stackable base element for a two-piece traffic channelizing element as defined in claim 35 wherein the top surfaces of each of the stackable base elements has a stacking ring arranged around said base aperture at an elevation below the level of the aperture and for receiving said dependent elements of another base element therein in a stacked relationship.

* * * * *

UNITED STATES PATENT AND TRADEMARK OFFICE

CERTIFICATE OF CORRECTION

PATENT NO. : 5,026,204

DATED : June 25, 1991

INVENTOR(S) : Jack H. Kulp et al

It is certified that error appears in the above-identified patent and that said Letters Patent is hereby corrected as shown below:

Column 2, line 21, cancel "to" and substitute ---top--.

Column 8, line 36, cancel "ballastor" and substitute -- ballast or--"

Column 16, line 26, cancel "and when assembled and disassem--"

Column 16, line 27, cancel "bled to one another"

Signed and Sealed this

Sixteenth Day of March, 1993

*Attest:*

STEPHEN G. KUNIN

*Attesting Officer*

*Acting Commissioner of Patents and Trademarks*